US008856983B2

(12) United States Patent
Hayek

(10) Patent No.: US 8,856,983 B2
(45) Date of Patent: Oct. 14, 2014

(54) ADJUSTABLE BED

(75) Inventor: Sami Hayek, Hollywood, CA (US)

(73) Assignee: Espacio, LLC, New York, NY (US)

( * ) Notice: Subject to any disclaimer, the term of this patent is extended or adjusted under 35 U.S.C. 154(b) by 0 days.

(21) Appl. No.: 13/606,983

(22) Filed: Sep. 7, 2012

(65) Prior Publication Data

US 2013/0111662 A1 May 9, 2013

Related U.S. Application Data

(60) Provisional application No. 61/557,697, filed on Nov. 9, 2011.

(51) Int. Cl.
*A47C 19/04* (2006.01)

(52) U.S. Cl.
CPC ..... *A47C 19/04* (2013.01)
USPC ..... 5/181; 5/308; 5/185; 5/53.1

(58) Field of Classification Search
CPC ..... A47C 19/04; A47C 17/32; A47C 23/005; A61G 7/0507; A61G 2007/0519; A61G 2007/0509; A61G 7/002; F16B 12/32; F16B 12/60; F16B 12/58; A47D 7/01; B60N 2/34; B60P 3/39
USPC ..... 5/181, 185, 53.1, 308, 236.1
See application file for complete search history.

(56) References Cited

U.S. PATENT DOCUMENTS

| | | | | | |
|---|---|---|---|---|---|
| 117,775 | A | * | 8/1871 | Hart | 5/18.1 |
| 134,359 | A | * | 12/1872 | Caro | 5/183 |
| 337,936 | A | * | 3/1886 | Detterer | 5/236.1 |
| 402,129 | A | * | 4/1889 | Beckert | 5/183 |
| 490,201 | A | * | 1/1893 | Hofacker | 5/183 |
| 954,594 | A | * | 4/1910 | Shaw | 297/233 |
| 1,640,754 | A | * | 8/1927 | Covey | 5/183 |
| 2,112,702 | A | * | 3/1938 | Loibl | 5/600 |
| 2,462,524 | A | * | 2/1949 | Mattedi | 5/308 |
| 2,697,233 | A | * | 12/1954 | Christenson | 5/131 |
| 2,784,421 | A | * | 3/1957 | Fredman | 5/131 |
| 4,384,379 | A | | 5/1983 | Yamada | |
| 4,613,999 | A | * | 9/1986 | Franco et al. | 5/400 |
| 4,826,235 | A | | 5/1989 | Zwick | |
| 5,392,475 | A | * | 2/1995 | McCall et al. | 5/18.1 |
| 6,115,858 | A | * | 9/2000 | Mitchell | 5/200.1 |

(Continued)

FOREIGN PATENT DOCUMENTS

EP 1 385 405 B1 11/2006

*Primary Examiner* — William Kelleher
*Assistant Examiner* — Duoni Pan
(74) *Attorney, Agent, or Firm* — Myers Bigel Sibley & Sajovec

(57) ABSTRACT

An adjustable bed frame includes a headboard, a pair of longitudinal side rails in spaced-apart, parallel relationship, and a telescoping slat assembly connecting the headboard and side rails together to define a rectangular bed frame that is adjustable between a first rectangular size and a second rectangular size smaller than the first rectangular size. The telescoping slat assembly includes a set of tubular members that telescopically receive a respective set of elongated members to form telescoping slats. The tubular members have one end secured to one of the side rails and extend away therefrom in parallel, spaced apart relationship. The elongated members have one end secured to the other one of the side rails and extend away therefrom in parallel, spaced-apart relationship. The side rails are slidably secured to the headboard to facilitate movement of the frame between the first and second rectangular sizes.

13 Claims, 9 Drawing Sheets

(56) References Cited

U.S. PATENT DOCUMENTS 6,134,724 A 10/2000 Brown
6,269,498 B1 8/2001 Perkins
6,292,960 B1 * 9/2001 Bowling ..... 5/308
6,711,765 B1 3/2004 Mitchell, III et al.

* cited by examiner

ADJUSTABLE BED

RELATED APPLICATION

This application claims the benefit of and priority to U.S. Provisional Patent Application No. 61/557,697 filed Nov. 9, 2011, the disclosure of which is incorporated herein by reference as if set forth in its entirety.

FIELD OF THE INVENTION

The present invention relates generally to furniture and, more particularly, to beds.

BACKGROUND

Beds conventionally are made to receive a single size mattress. Exemplary, standardized mattress sizes include, for example, king, queen, California king, double and single. Conventional bed frames typically are not easily adjustable in size so as to accommodate more than one size of mattress.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, an adjustable bed frame includes a headboard, a pair of longitudinal side rails in spaced-apart, parallel relationship, and a telescoping slat assembly connecting the headboard and side rails together to define a rectangular bed frame that is adjustable between a first rectangular size (e.g., king size, etc.) and a second rectangular size (e.g., queen size, etc.) smaller than the first rectangular size. The telescoping slat assembly includes a set of tubular members that telescopically receive a respective set of elongated members to form telescoping slats. The tubular members have one end secured to one of the side rails and extend away therefrom in parallel, spaced apart relationship. The elongated members have one end secured to the other one of the side rails and extend away therefrom in parallel, spaced-apart relationship. The telescoping slat assembly may have various numbers of telescoping slats (e.g., at least seven slats, at least eight slats, at least ten slats, etc.).

In some embodiments of the present invention, one or more of the telescoping slats includes a bushing that guides a respective elongated member along a controlled sliding path within the tubular member. The bushing facilitates smooth telescoping movement and also prevents rattling and other vibrations between a tubular member and corresponding elongated member.

The headboard includes opposite end portions and, in some embodiments of the present invention, each side rail extends away from the headboard at a respective end portion when the frame is in the first rectangular size (e.g., king size). When the frame is in the second rectangular size (e.g., queen size), at least one of the side rails extends away from the headboard at an intermediate location between the headboard end portions. The side rails are slidably secured to the headboard to facilitate movement of the frame between the first and second rectangular sizes. In some embodiments of the present invention, the headboard comprises a bottom end portion having a groove formed therein. Each side rail is slidably secured to the headboard via an "L-shaped" member having one end secured to the side rail and an opposite end slidably engaged within the groove.

The side rails of the adjustable bed frame have opposite first and second end portions. The first end portions are slidably secured to the headboard and the second end portions are removably secured to a footboard extending therebetween when the frame is in the second rectangular size. A pair of leg members are inserted between the footboard and side rails when the adjustable bed frame is in the first rectangular size. Each leg member extends between and is secured to a respective side rail and the footboard.

In some embodiments of the present invention, the adjustable frame includes at least one drawer slidably secured to the frame. In some embodiments of the present invention, the at least one drawer is slidably secured to the bed frame adjacent to the footboard (e.g., beneath the footboard). In some embodiments of the present invention, the at least one drawer comprises a pair of adjacent drawers.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate some exemplary embodiments. The drawings and description together serve to fully explain the exemplary embodiments.

DETAILED DESCRIPTION

Figure 1:
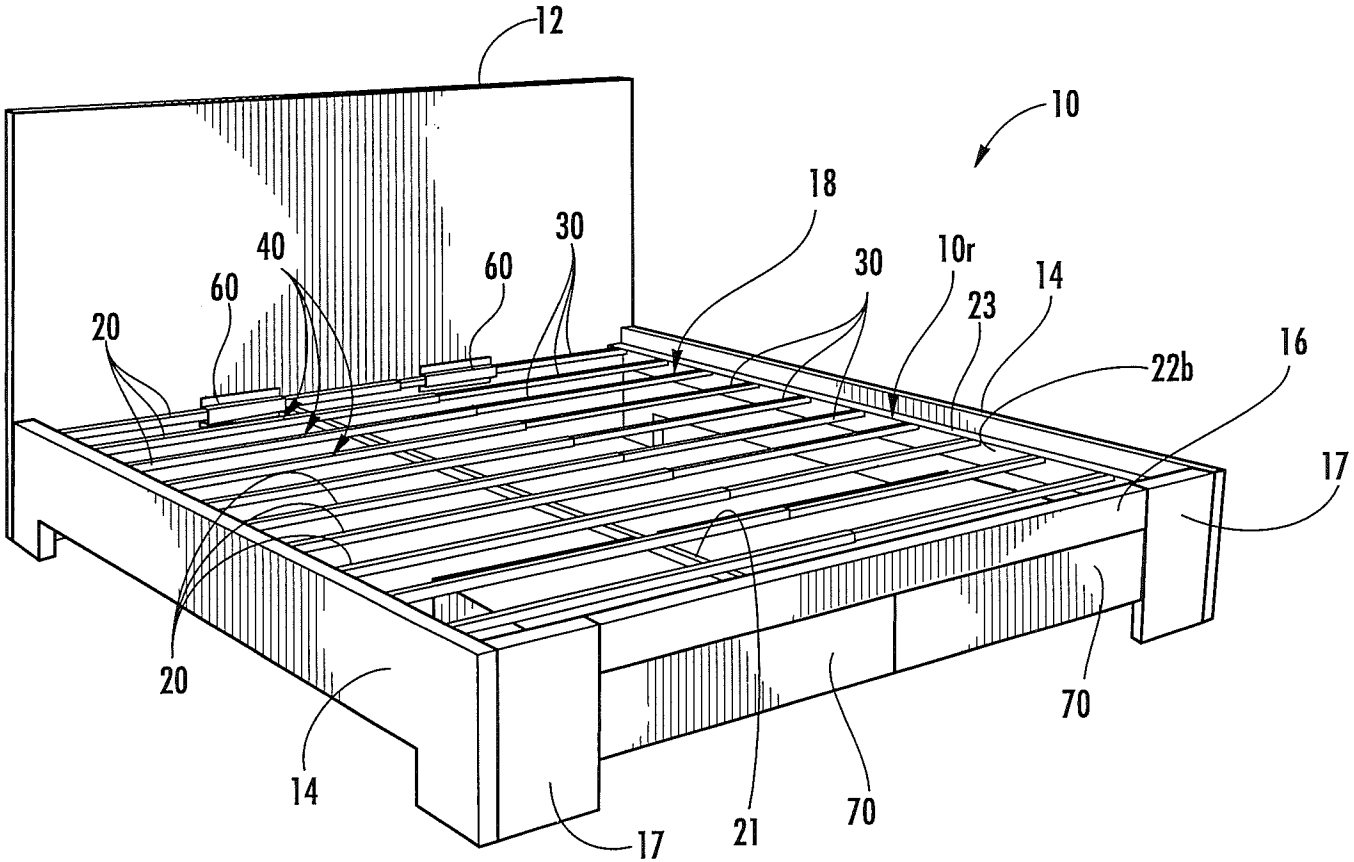
FIG. 1 is a perspective view of an adjustable bed frame in a first size configuration, according to some embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain components or features may be exaggerated for clarity, and broken lines may illustrate optional features or elements unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that although the terms first and second are used herein to describe various features or elements, these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

Figure 2A:
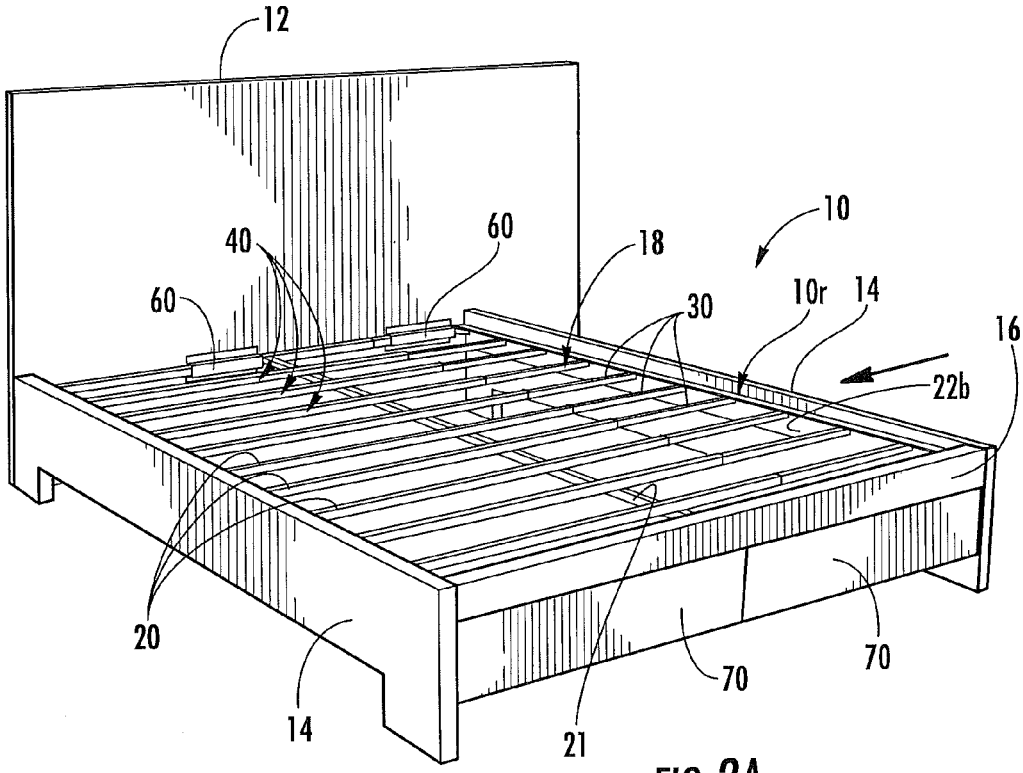
FIGS. 2A-2B are perspective views of the adjustable bed frame of FIG. 1 in respective different second size configurations that are smaller than the first size configuration of FIG. 1, according to some embodiments of the present invention.
Figure 2B:
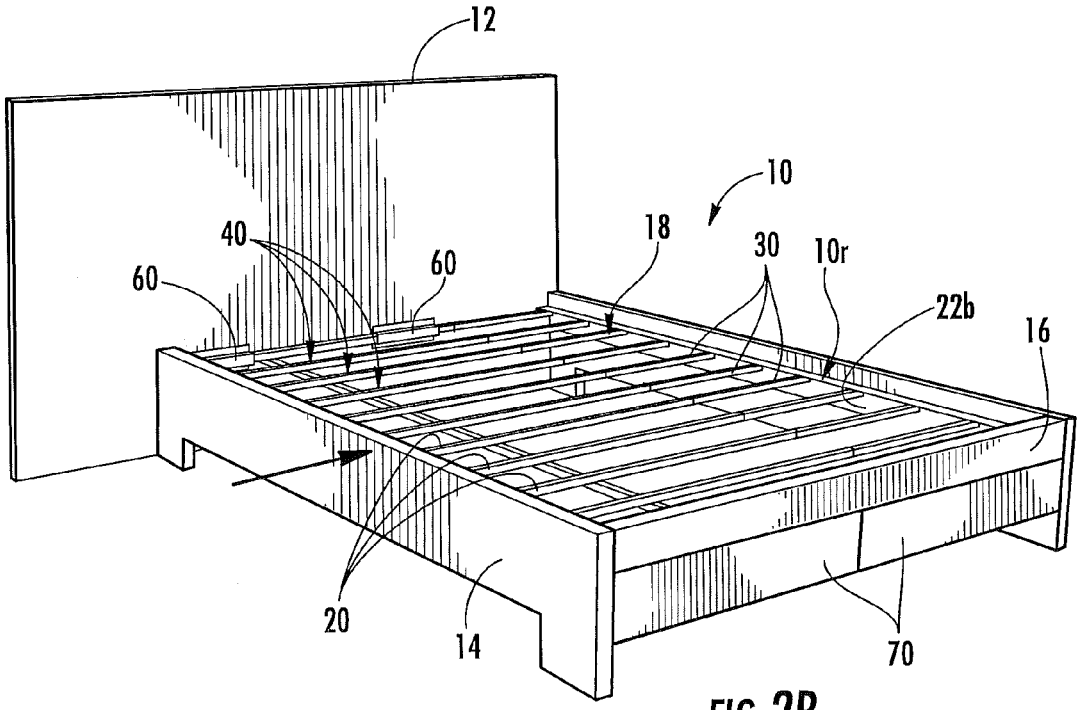

Referring now to the figures, an adjustable bed frame 10, according to some embodiments of the present invention, is illustrated. The adjustable bed frame 10 includes a headboard 12, a pair of longitudinal side rails 14 in spaced-apart, parallel relationship, a footboard assembly 16, a pair of removable leg members 17, and a telescoping slat assembly 18 connecting the headboard 12, footboard assembly 16, leg members 17, and side rails 14 together to define a rectangular bed frame that is adjustable in size. In the illustrated embodiment, the bed frame 10 is adjustable between a first rectangular size (FIG. 1) and a second rectangular size (FIGS. 2A and 2B) smaller than the first rectangular size. For example, as illustrated in FIG. 1, the adjustable bed frame 10 is in a king size configuration. In FIGS. 2A-2B, the adjustable bed frame 10 has been moved to a smaller, queen size configuration. Adjustable bed frames according to embodiments of the present invention, however, are not limited only to movement between king and queen sizes. Bed frames according to embodiments of the present invention may be movable between virtually any number and type of sizes. For example, a bed frame 10 according to embodiments of the present invention may be movable between king and double sizes, between queen and double sizes, between king and California king sizes, etc.

As illustrated in FIGS. 2A and 2B, when the bed frame 10 is moved to a smaller size, the bed frame may be oriented to the left (FIG. 2A) or to the right (FIG. 2B) of the headboard. In FIG. 2A, the bed frame 10 is in a "queen size left" configuration and, in FIG. 2B, the bed frame 10 is in a "queen size right" configuration. When the bed frame 10 is moved to a smaller size, the leg members 17 are removed as will be described below.

Figures 3A, 3B:
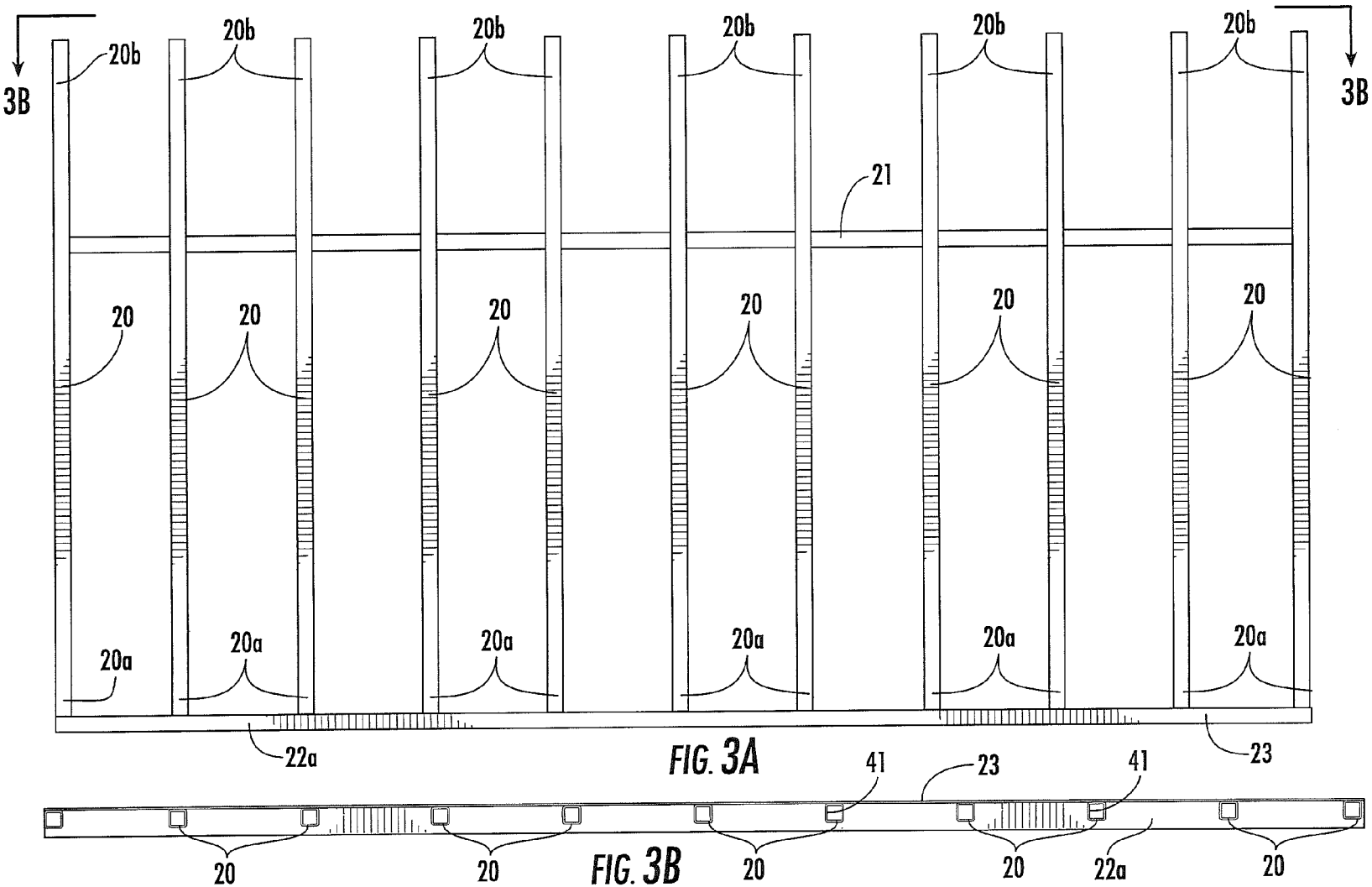
FIG. 3A is a plan view of a set of tubular members configured to telescopically receive a respective set of elongated members to form respective telescoping slats, according to some embodiments of the present invention.
FIG. 3B is an end view of the set of tubular members of FIG. 3A taken along lines 3B-3B.
Figure 6:
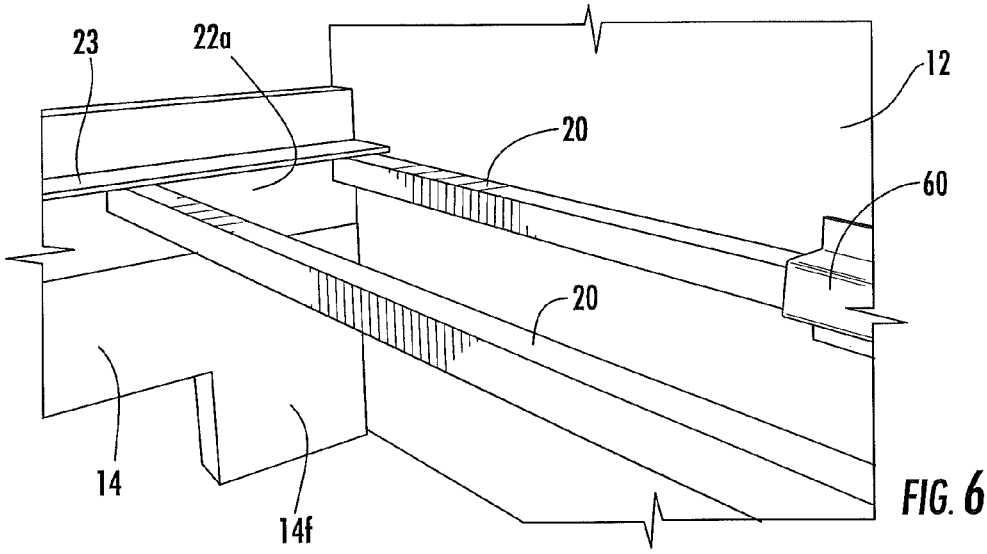
FIGS. 6 and 7 are partial perspective views of the adjustable bed frame of FIG. 1 illustrating the telescoping slat assembly secured to a side rail and slidably secured to the headboard, according to some embodiments of the present invention.
Figure 7:
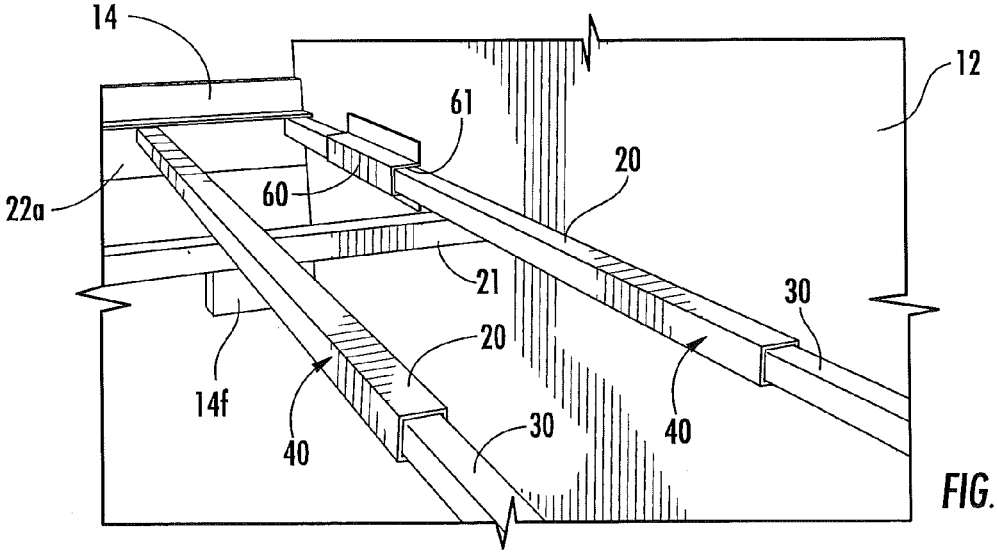

The telescoping slat assembly 18 includes a set of elongated tubular members 20 (FIGS. 3A-3B) that telescopically receive a respective set of elongated members 30 (FIGS. 4A-4B) therein to form telescoping slats 40 (FIGS. 1, 2A-2B). Each elongated tubular member 20 includes opposite first and second ends 20*a*, 20*b* (FIG. 3A). The first end 20*a* of each elongated tubular member 20 is attached to an "L-shaped", rigid bracket 22*a* such that the tubular members 20 extend away therefrom in parallel, spaced apart relationship, as illustrated in FIG. 3A. The bracket 22*a* is attached to the left side rail 14, as illustrated in FIGS. 6 and 7. The second end 20*b* of each tubular member 20 is open and contains a passageway configured to receive a respective elongated member 30 therein.

A reinforcing member 21 is attached to and extends beneath the elongated tubular members 20, as illustrated in FIGS. 1, 2A-2B, 2A and 7. Reinforcing member 21 provides stability and additional structural rigidity to the set of elongated tubular members 20. Reinforcing member 21 may have various shapes and configurations and is not limited to the illustrated embodiment. For example, in some embodiments, the reinforcing member may extend between the elongated tubular members 20. In addition, the reinforcing member 21 may include one or more supports (not shown) extending downwardly therefrom to the floor to provide additional support for the telescoping slat assembly 18.

Figures 4A, 4B:
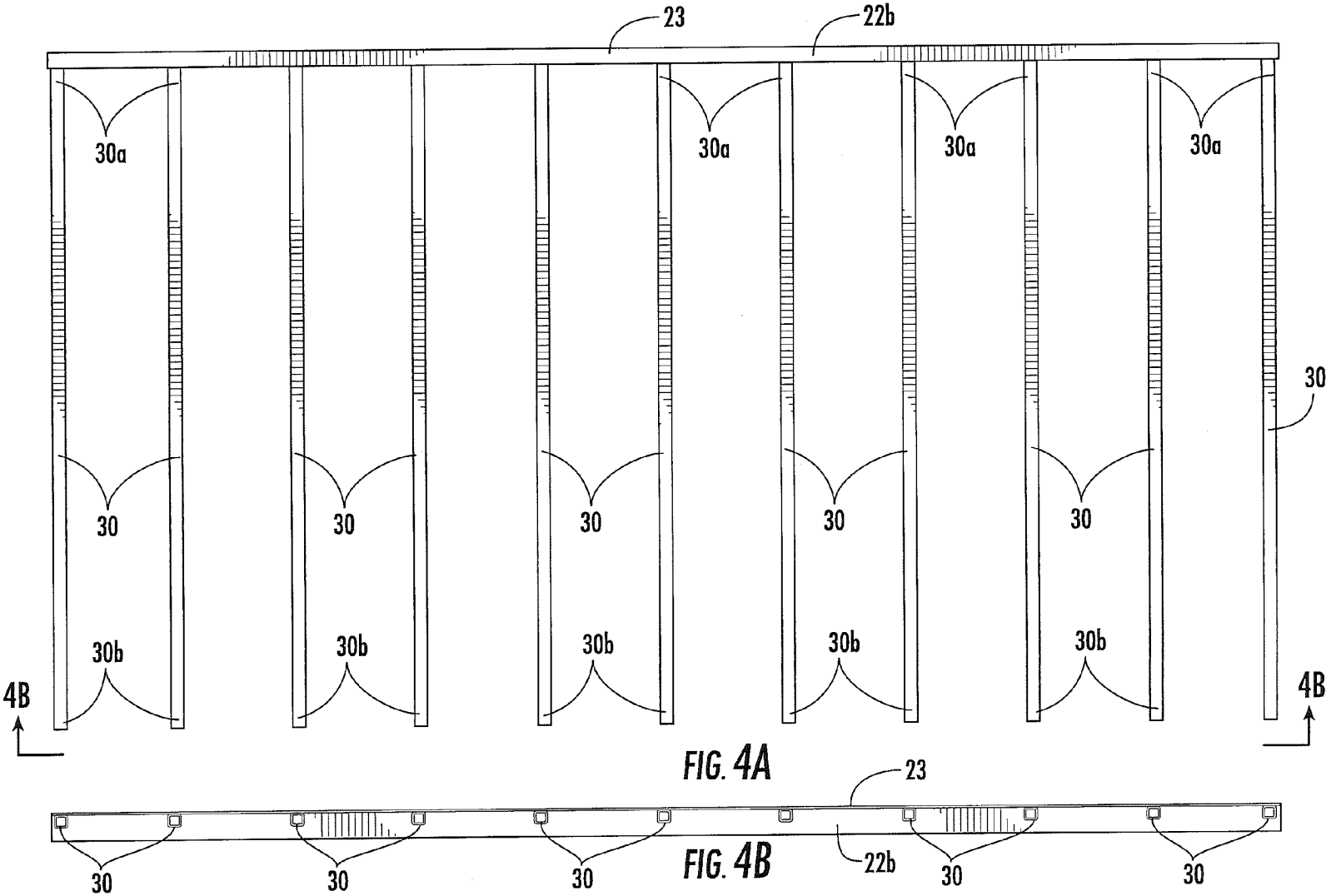
FIG. 4A is a plan view of a set of elongated members configured to telescopically engage the tubular members of FIG. 3A to form respective telescoping slats, according to some embodiments of the present invention.
FIG. 4B is an end view of the set of elongated members of FIG. 4A taken along lines 4B-4B.

Each elongated member 30 includes opposite first and second ends 30*a*, 30*b* (FIG. 4A). The first end 30*a* of each elongated member 30 is attached to an "L-shaped", rigid bracket 22*b* such that the elongated members 30 extend away therefrom in parallel, spaced apart relationship, as illustrated in FIG. 4A. The bracket 22*b* is attached to the right side rail 14, as illustrated in FIGS. 2A and 2B. The second end 30*b* of each elongated member 30 is configured to be inserted within a respective tubular member 20 to form a respective telescoping slat 40. Brackets having other shapes may be utilized to secure the elongated tubular members 20 and the elongated members 30 to the respective side rails. Embodiments of the present invention are not limited to the "L-shaped" brackets 22*a*, 22*b*.

In addition, the orientation of the tubular members 20 and the elongated members 30 can be reversed in other embodiments of the present invention. For example, the bracket 22*a* with elongated tubular members 20 could be secured to the right side rail 14 and the bracket 22*b* with elongated members 30 could be secured to the left side rail 14.

As illustrated in FIGS. 1 and 2A-2B, the brackets 22*a*, 22*b* are secured to the respective rails 14 below the upper edge portion 14*c* thereof. As such, the telescoping slat assembly 18, side rails 14, and headboard 12 form a receptacle 10*r* for receiving a mattress or mattress foundation (e.g., a box spring, etc.). Each bracket 22*a*, 22*b* has an upper portion 23, as illustrated. The upper portion 23 of each bracket 22*a*, 22*b* provides support for the edges of a mattress or mattress foundation, as would be understood by one skilled in the art.

Embodiments of the present invention do not require use of brackets 22*a*, 22*b*. Alternatively, the first end portions 20*a* of the tubular members 20 and the first end portions 30*a* of the elongated members 30 may be directly attached to the respective side rails 14.

In some embodiments of the present invention, one or more of the telescoping slats 40 includes a bushing 41 (FIG. 3B) disposed within the tubular member 20. The bushing 41 may be located adjacent the second end 20*b* or may be located at an intermediate location within the tubular member 20. The bushing 41 is configured to guide a respective elongated member 30 along a controlled sliding path within the tubular member 20. The bushing 41 facilitates smooth telescoping movement and also prevents rattling and other vibrations between a tubular member 20 and corresponding elongated member 30. Embodiments of the present invention are not limited to any particular type or shape of bushing 41. Various types of bushings may be utilized, without limitation.

In the illustrated embodiment, the telescoping slat assembly 18 includes eleven (11) telescoping slats 40. However, embodiments of the present invention are not limited to any particular number of telescoping slats 40. Various other numbers of slats 40 may be utilized, without limitation. For example, at least seven (7), eight (8) or ten (10) slats 40 may be utilized. In other embodiments, more than eleven (11) telescoping slats 40 may be utilized.

The elongated tubular members 20, elongated members 30, and brackets 22*a*, 22*b* may be formed from various materials, without limitation. Exemplary materials include, but are not limited to, aluminum, steel, and various polymeric materials. The brackets 22*a*, 22*b* may be attached to respective side rails 14 using fasteners (e.g., screws, rivets, bolts, threaded rods, etc.). The elongated tubular members 20 may be secured to bracket 22*a* via welding, fasteners, or other known techniques. Similarly, the elongated members 30 may be secured to bracket 22*b* via welding, fasteners, or other known techniques.

Figures 8, 9:
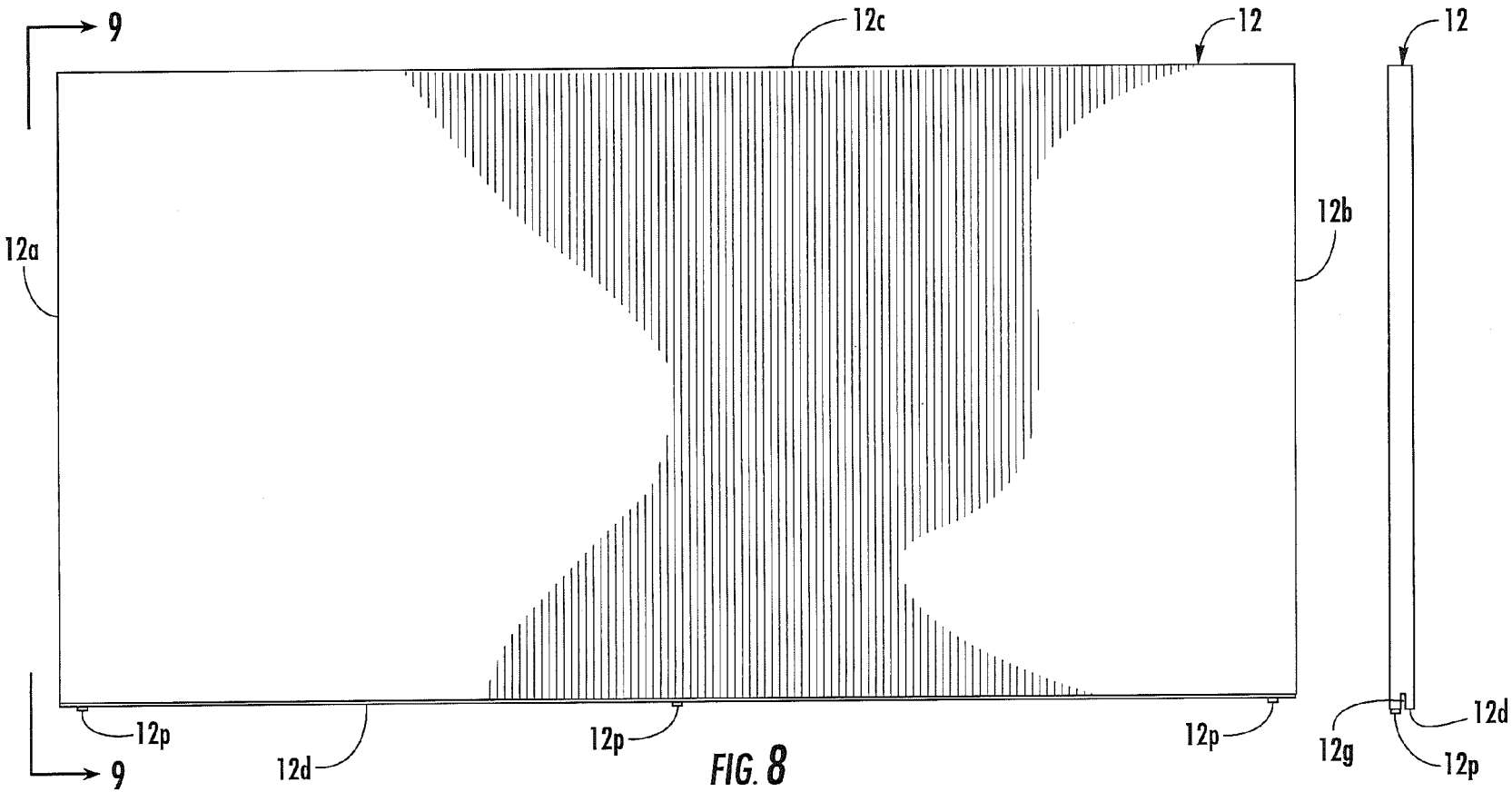
FIG. 8 is a plan view of the headboard of the adjustable bed frame of FIG. 1, according to some embodiments of the present invention.
FIG. 9 is a side view of the headboard of FIG. 8 taken along lines 9-9.

The headboard 12, side rails 14, footboard assembly 16, and leg members 17 may be formed from various materials. Exemplary materials include, but are not limited to, wood, particle board, metal, and the like. The illustrated headboard 12 has a generally rectangular shape and includes opposite end portions 12*a*, 12*b* and opposite top and bottom end portions 12*c*, 12*d* (FIG. 8). The headboard 12 is not limited to the illustrated rectangular configuration. The headboard 12 may have various other configurations including non-rectangular configurations. The illustrated headboard 12 includes a groove 12*g* formed within the bottom end portion 12*d*, as illustrated in FIG. 9. In addition, the illustrated headboard 12 includes a plurality of pad members 12*p* on the bottom end portion 12*d*. Pad members 12*d* may be shaped and/or formed from material that facilitates sliding the bed frame 10 on a floor or floor covering.

Figure 10A:
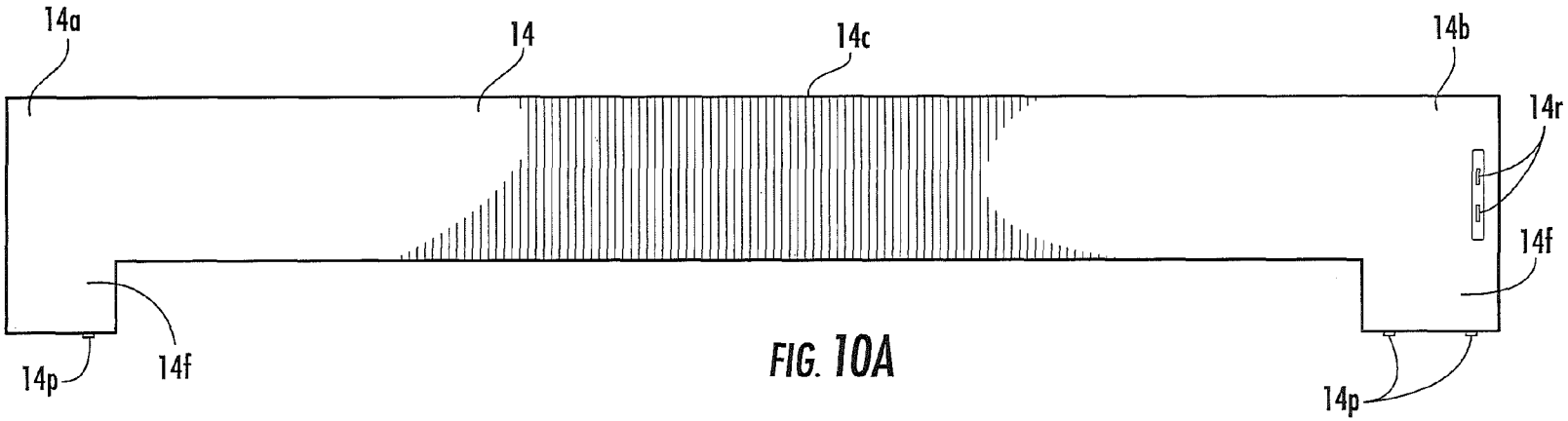
FIGS. 10A and 10B are side plan views of the respective first and second rails of the adjustable bed frame of FIG. 1, according to some embodiments of the present invention.
Figure 10B:
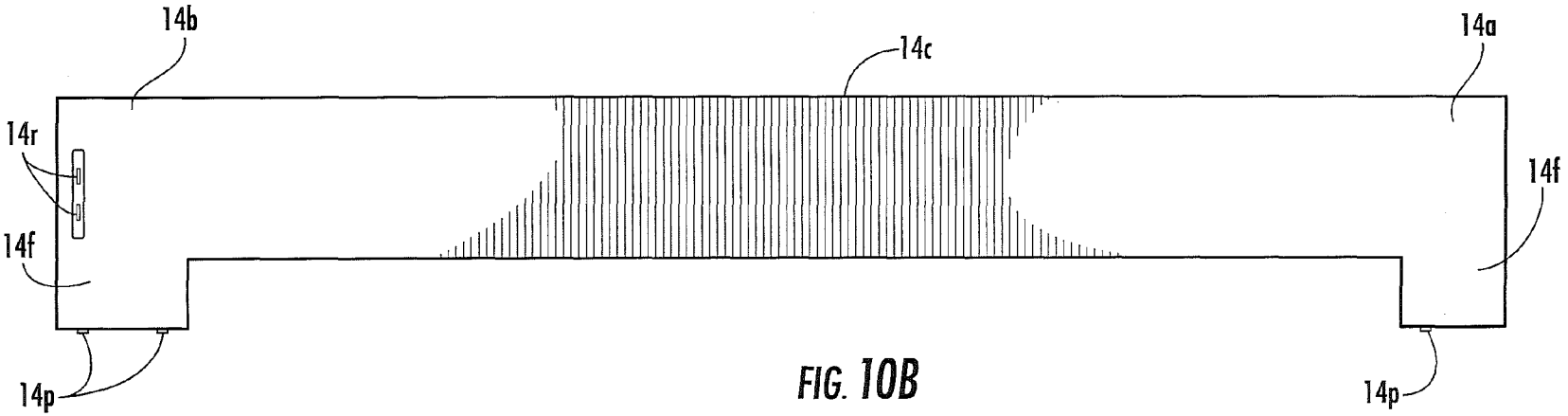

Referring to FIGS. 10A-10B, each side rail 14 includes opposite first and second end portions 14*a*, 14*b*. FIG. 10A illustrates the side rail 14 on the right side of the illustrated bed frame 10 of FIG. 1 and FIG. 10B illustrates the side rail 14 on the left side of the illustrated bed frame 10 of FIG. 1. Each side rail end portion 14*a*, 14*b* includes a foot portion 14*f*, and each foot portion includes at least one pad member 14*p*. Pad members 14*p* may be shaped and/or formed from material that facilitates sliding the side rails, as well as the bed frame 10, on a floor or floor covering. Each side rail second end portion 14*b* includes female receptacles 14*r* (FIGS. 10A-10B) for receiving corresponding male connectors from the footboard assembly 16 and from the leg members 17, as described below.

Figure 5:
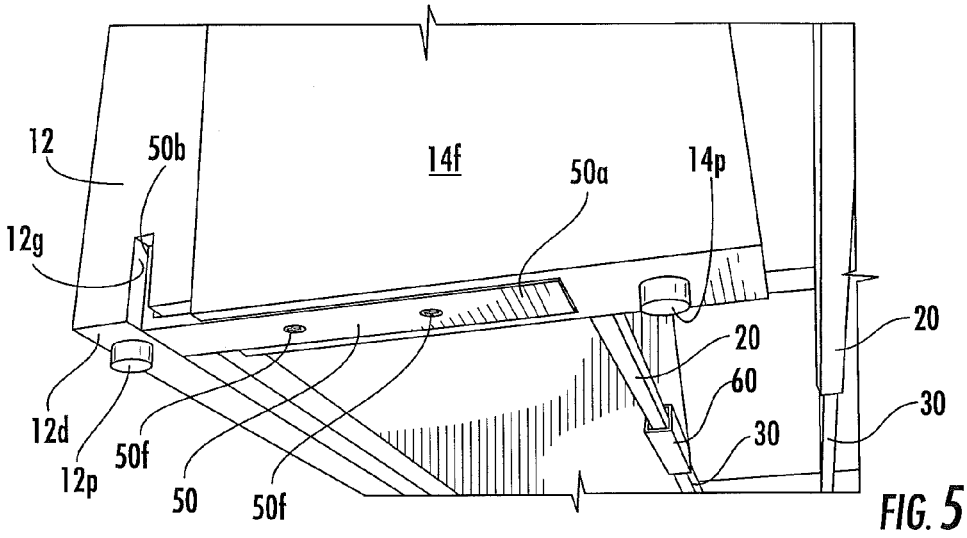
FIG. 5 is a bottom partial perspective view of the adjustable bed frame of FIG. 1 illustrating a side rail slidably secured to the headboard, according to some embodiments of the present invention.

The foot portion 14*f* at the first end portion 14*a* is configured to be slidably secured to the headboard 12 to facilitate expansion and contraction of the bed frame 10. In the illustrated embodiment, one end 50*a* of an "L-shaped" bracket 50 is attached to a bottom portion 14*d* of rail foot portion 14*f* via fasteners 50*f* (e.g., screws, bolts, rivets, etc.) and the other end 50*b* of the bracket 50 is positioned within the groove 12*g* in the headboard bottom end portion 12*d*, as illustrated in FIG. 5. This allows either rail 14 to be moved relative to the headboard 12. For example, as illustrated in FIG. 2A, the right side rail 14 has been moved to adjust the size of the bed frame 10 and in FIG. 2B, the left side rail 14 has been moved to adjust the size of the bed frame 10.

In the illustrated embodiment, the telescoping slat assembly 18 is slidably secured to the headboard 12 via a pair of brackets 60. Each bracket 60 is secured to the headboard 12, via fasteners (e.g., screws, rivets, bolts, threaded rods, etc.) and has a generally "U-shaped" configuration that defines a passageway 61 (FIG. 7). The telescoping slat 40 adjacent to the headboard 12 is positioned within the brackets 60 as illustrated in FIGS. 1, 2A-2B and 7.

Figure 11A:
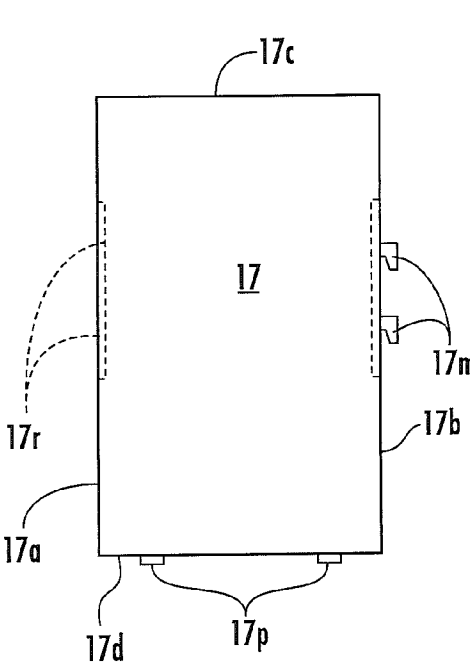
FIGS. 11A and 12A are front plan views of the respective first and second leg members of the adjustable bed frame of FIG. 1, according to some embodiments of the present invention.
Figure 11B:
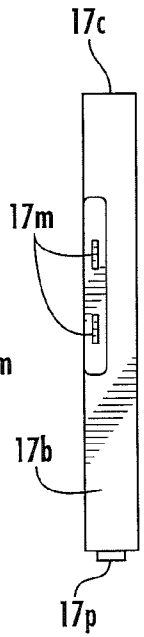
FIGS. 11B and 12B are side plan views of the respective first and second leg members of FIGS. 11A and 11B.
Figure 11C:
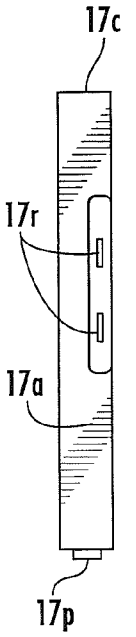
FIGS. 11C and 12C are side plan views of the respective first and second leg members of FIGS. 11A and 11B opposite that shown in FIGS. 11B and 12B.
Figure 12A:
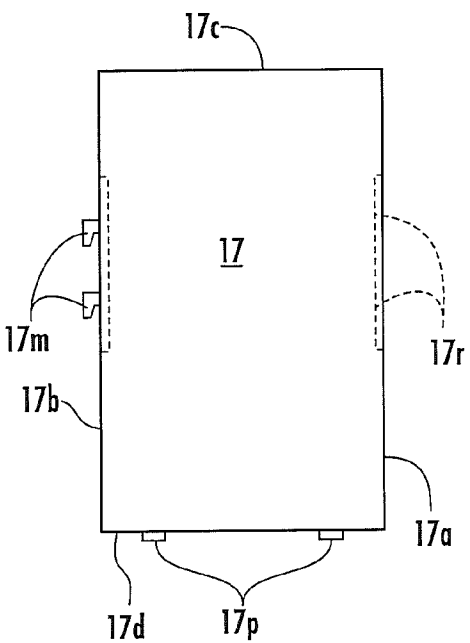
Figure 12B:
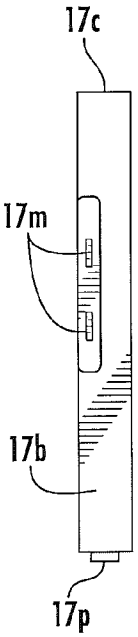
Figure 12C:
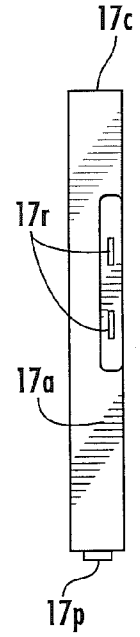

The illustrated bed frame 10 also includes two removable leg members 17. Referring to FIGS. 11A-11C and 12A-12C, each leg member 17 includes opposite first and second end portions 17*a*, 17*b* and opposite upper and lower portions 17*c*, 17*d*. FIGS. 11A-11C illustrate the leg member 17 on the right side of the illustrated bed frame 10 of FIG. 1 and FIGS. 12A-12C illustrate the leg member 17 on the left side of the illustrated bed frame 10 of FIG. 1. The lower portion of each leg member includes at least one pad member 17*p*. Pad members 17*p* may be shaped and/or formed from material that facilitates sliding on a floor or floor covering.

Figure 13:
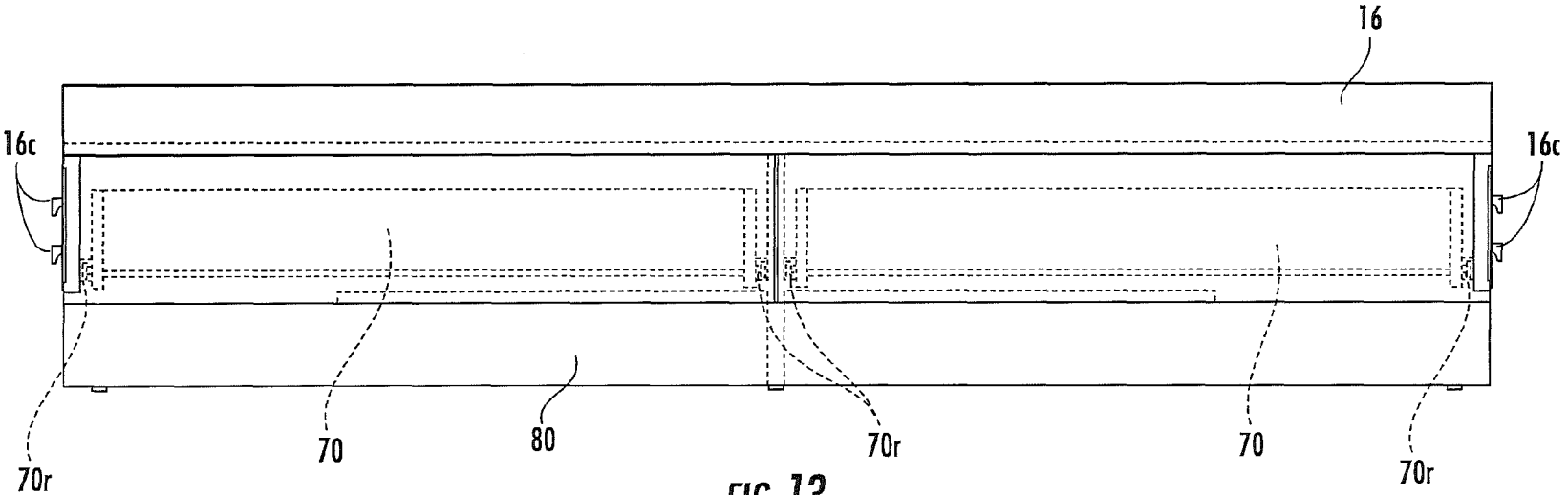
FIG. 13 is a front plan view of a drawer assembly attached to the adjustable bed frame of FIG. 1, according to some embodiments of the present invention.

The first end portion 17*a* of each leg member 17 includes female receptacles 17*r* (FIGS. 11C, 12C) for receiving corresponding male connectors 16*c* extending from the footboard assembly 16 (FIG. 13). The second end portion 17*b* of each leg member 17 includes male connectors 17*m* (FIGS. 11A, 12A, 11B, 12B) that are configured to be removable secured within respective female receptacles 14*r* (FIGS. 10A-10B) in the side rails 14. Thus, when the bed frame 10 is assembled in the first (i.e., largest) size (FIG. 1), each leg member 17 is connected to the footboard assembly 16 via the footboard assembly male connectors 16*c* engaging with the female receptacles 17*r* in the leg members 17, and each leg member 17 is connected to a respective side rail 14 via the leg member male connectors 17*m* engaging with the female receptacles 14*r* in the side rail second end portions 14*b*. When the bed frame is move to a smaller size (FIGS. 2A-2B), the leg members 17 are removed and each side rail 14 is connected to the footboard assembly 16 via the footboard assembly male connectors 16*c* engaging with the female receptacles 14*r* in the side rail second end portions 14*b*.

In the illustrated embodiment, the adjustable bed frame 10 also includes a pair of adjacent drawers 70 slidably secured to the frame 10. The drawers 70 are positioned beneath the footboard assembly 16. The drawers 70 are extendable and retractable relative to the bed frame 10 via rollers 70*r* or other mechanisms, as would be understood by one skilled in the art of the present invention. Embodiments of the present invention do not require drawers. Moreover, a single drawer may be utilized or more than two drawers may be utilized. Embodiments of the present invention are not limited to the illustrated number or configuration of drawers 70. In the illustrated embodiment, a panel 80 is attached to the bed frame 10 beneath the drawers 70 to provide support therefor.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. An adjustable bed frame, comprising:

a headboard comprising opposite side end portions and a bottom end portion, wherein a groove is formed within the headboard bottom end portion and extends from one side end portion to the other side end portion;

a pair of longitudinal side rails in spaced-apart, parallel relationship, wherein each side rail is slidably secured to the headboard via a member having one end secured to the side rail and an opposite end slidably engaged within the groove in the headboard bottom end portion; and a telescoping slat assembly connecting the headboard and side rails together to define a rectangular bed frame that is adjustable between a first rectangular size and a second rectangular size smaller than the first rectangular size, wherein the telescoping slat assembly comprises:

a set of tubular members having one end secured to one of the side rails and extending away therefrom in parallel, spaced apart relationship;

a set of elongated members having one end secured to the other one of the side rails and extending away therefrom in parallel, spaced-apart relationship, wherein each tubular member telescopically receives a respective elongated member therein to form a respective telescoping slat;

a bushing disposed within one of the tubular members that is configured to guide a respective elongated member along a controlled sliding path within the tubular member; and a pair of removable leg members, each leg member extending between and removably secured to a respective side rail and to the footboard when the bed frame is in the first rectangular size, and wherein each leg member is removed from a respective side rail and from the footboard when the bed frame is adjusted to the second rectangular size.

2. The bed frame of claim 1, wherein the telescoping slat assembly comprises at least seven telescoping slats.

3. The bed frame of claim 1, wherein the telescoping slat assembly comprises at least eight telescoping slats.

4. The bed frame of claim 1, wherein the telescoping slat assembly comprises at least ten telescoping slats.

5. The bed frame of claim 1, wherein the first and second set of tubular members extend orthogonally away from the respective side rails.

6. The bed frame of claim 1, wherein each side rail extends away from the headboard at a respective side end portion when the frame is in the first rectangular size, and wherein at least one of the side rails extends away from the headboard at a location between the headboard side end portions when the frame is in the second rectangular size.

7. The bed frame of claim 1, wherein the side rails have opposite first and second end portions, wherein the first end portions are slidably secured to the headboard, and further comprising a footboard extending between and secured to the side rail second end portions when the frame is in the second rectangular size.

8. The bed frame of claim 7, further comprising at least one drawer slidably secured to the bed frame adjacent to the footboard.

9. The bed frame of claim 8, wherein the at least one drawer comprises a pair of adjacent drawers.

10. The bed frame of claim 8, wherein the at least one drawer is slidably secured to the bed frame beneath the footboard.

11. The bed frame of claim 1, wherein one of the telescoping slats is slidably secured to the headboard via a pair of spaced-apart brackets mounted to the headboard.

12. The bed frame of claim 1, further comprising at least one drawer slidably secured to the bed frame.

13. An adjustable bed frame, comprising:

a headboard comprising opposite end portions and a bottom end portion, wherein a groove is formed within the headboard bottom end portion and extends from one end portion to the other end portion;

a pair of longitudinal side rails in spaced-apart, parallel relationship, wherein each side rail is slidably secured to the headboard via an "L-shaped" member having one end secured to the side rail and an opposite end slidably engaged within the groove in the headboard bottom end portion; and a telescoping slat assembly connecting the headboard and side rails together to define a rectangular bed frame that is adjustable between a first rectangular size and a second rectangular size smaller than the first rectangular size, wherein the telescoping slat assembly comprises:

a set of tubular members having one end secured to one of the side rails and extending away therefrom in parallel, spaced apart relationship;

a set of elongated members having one end secured to the other one of the side rails and extending away therefrom in parallel, spaced-apart relationship, wherein each tubular member telescopically receives a respective elongated member therein to form a respective telescoping slat; and a pair of removable leg members, each leg member extending between and removably secured to a respective side rail and to the footboard when the bed frame is in the first rectangular size, and wherein each leg member is removed from a respective side rail and from the footboard when the bed frame is adjusted to the second rectangular size.

* * * * *